US005662399A

United States Patent [19]

Henkel et al.

[11] Patent Number: 5,662,399

[45] Date of Patent: Sep. 2, 1997

[54] READY-TO-ASSEMBLE CABINET

[75] Inventors: Richard E. Henkel, Burlington; William A. Matzke, Pinehurst; James T. Phillips, Sanford, all of N.C.

[73] Assignee: Doxey Furniture Corporation, Aberdeen, N.C.

[21] Appl. No.: 523,020

[22] Filed: Sep. 1, 1995

[51] Int. Cl.[6] ..... A47B 43/02

[52] U.S. Cl. ..... 312/258; 411/339; 411/455; 312/259; 108/107; 211/195

[58] Field of Search ..... 312/258, 259, 312/108, 257.1; 108/106, 107, 110; 229/120.32; 211/195, 149, 186; 248/247, 250, 239; 411/339, 455

[56] References Cited

U.S. PATENT DOCUMENTS

| | | | |
|---|---|---|---|
| D. 31,685 | 10/1899 | Spear . | |
| 168,879 | 10/1875 | Colbert | 312/258 X |
| 414,580 | 11/1889 | Price et al. . | |
| 724,897 | 4/1903 | Lee . | |
| 1,199,293 | 9/1916 | Montgomery | 312/258 |
| 1,602,410 | 10/1926 | Hamblin | 312/258 X |
| 1,947,195 | 4/1934 | Flynn | 211/156 |
| 1,988,695 | 11/1935 | Marsh | 211/157 |
| 2,576,750 | 11/1951 | Clark | 312/259 |
| 2,583,931 | 1/1952 | Cummings | 312/262 |
| 2,674,377 | 4/1954 | Davidson | 211/72 |
| 2,764,462 | 9/1956 | McDonald | 211/149 X |
| 3,140,133 | 7/1964 | Kraft | 312/258 X |
| 3,612,639 | 10/1971 | Williams | 312/330 |
| 3,766,864 | 10/1973 | Baker et al. | 211/195 X |
| 3,845,727 | 11/1974 | Chase | 108/111 |
| 3,883,258 | 5/1975 | Hewson | 403/298 |
| 3,966,339 | 6/1976 | Nemecek et al. | 403/292 |
| 4,082,388 | 4/1978 | Goeglein | 312/258 |
| 4,082,389 | 4/1978 | Stewart | 312/258 |
| 4,110,946 | 9/1978 | Louther, Jr. | 52/323 |
| 4,193,650 | 3/1980 | Gray et al. | 312/108 X |
| 4,208,971 | 6/1980 | Persson | 108/51.1 |
| 4,236,460 | 12/1980 | Poupko | 108/41 |
| 4,519,318 | 5/1985 | Weldon-Ming | 312/259 X |
| 4,676,383 | 6/1987 | Sheffer | 211/135 |
| 4,681,477 | 7/1987 | Fischer | 403/298 |
| 4,721,464 | 1/1988 | Roden et al. | 433/74 |
| 4,867,513 | 9/1989 | Choi | 312/198 X |
| 4,963,051 | 10/1990 | Hutter | 403/298 |
| 5,076,177 | 12/1991 | Chien | 108/107 X |

(List continued on next page.)

FOREIGN PATENT DOCUMENTS

| | | |
|---|---|---|
| 0 222 130 | 2/1987 | European Pat. Off. . |
| 1 370 660 | 10/1974 | United Kingdom . |
| 1 599 950 | 10/1981 | United Kingdom . |
| 2 241 637 | 8/1991 | United Kingdom . |

OTHER PUBLICATIONS

Tall Tower & Bookcase Assembly Instructions flyer; Doxey Furniture Corporation, Mar., 1995.

U.S. Patent Application of Kenneth L. Watts and David M. Wright entitled Folding Knock Down Cabinet; Assigned to Habitat Furniture, Inc., filed on or about Jan. 26, 1995.

*Primary Examiner*—James R. Brittain
*Assistant Examiner*—Stephen Vu
*Attorney, Agent, or Firm*—Rhodes, Coats & Bennett, L.L.P.

[57] ABSTRACT

A ready-to-assemble cabinet including two upstanding side panels, at least two fixed shelves between the side panels, a folding back panel attached to the side panels, and hardware for holding the components together. The cabinet may optionally include additional fixed and adjustable shelves. The back panel is preattached to the side panels by the manufacturer to create a back panel/side panel sub-assembly. The back panel includes a number of vertically scored fold lines running from top to bottom, which delineate longitudinal sections of the back panel. The scored fold lines permit the sub-assembly to be folded accordion-style for packaging, whereby the back panel sections are sandwiched between the side panels. Serrated plastic dowel pins hold the shelves to the side panels to eliminate the need for tools and/or adhesives and permit assembly of the cabinet in only three to five minutes.

19 Claims, 5 Drawing Sheets

U.S. PATENT DOCUMENTS 5,131,783 7/1992 Astl ..... 403/298
5,193,466 3/1993 Eder ..... 108/111
5,273,169 12/1993 Maglione ..... 211/149
5,348,526 9/1994 Feygin ..... 493/405
5,349,909 9/1994 Smit et al. ..... 108/107
5,370,241 12/1994 Silvers ..... 211/13

READY-TO-ASSEMBLE CABINET

FIELD OF THE INVENTION

The present invention relates generally to relatively inexpensive ready-to-assemble shelved furniture and, more particularly, to a partially pre-assembled cabinet or bookcase that can be folded accordion-style for packaging and can be assembled almost instantaneously without tools.

BACKGROUND OF THE INVENTION

Typical ready-to-assemble (RTA) furniture is shipped and sold to consumers in a disassembled state and must be erected by the consumer before use. Such RTA furniture is usually sold at a relatively low price in general retail stores, as compared to preassembled, higher-end furniture that is sold at a greater cost in furniture stores. While RTA furniture is usually very affordable, it also requires some degree of mechanical aptitude for proper assembly. The consumer must read and understand often inadequate instructions and use various tools to fit components together with an assortment of fasteners and adhesives. Additionally, typical RTA furniture takes a significant amount of time to assemble, often leading a consumer to pay someone else to assemble the RTA furniture who has a greater amount of skill and/or more time to perform the work. This can negate any money saved by purchasing RTA furniture instead of higher-end preassembled furniture.

A typical example of RTA furniture is a ready-to-assemble bookcase, which consists of laminated particle board panels that are held together with various pieces of hardware. The lamination may be paper, vinyl, wood veneer, etc. Manufactured by companies such as Doxey Furniture Corporation of Aberdeen, N.C., and sold at retail at prices ranging from forty to one hundred dollars, an RTA bookcase such as this comes packaged in a long, rectangular box and requires approximately forty minutes for assembly by a consumer with average mechanical skills and a few basic tools. The particle-board panels include upstanding left and right side panels, fixed top and bottom shelves, an optional fixed middle shelf, one or more optional adjustable shelves, and a toe kick panel. A thinner back panel is typically made of high-density cardboard and is also veneer-covered on its from surface to match the other panels. Typically, the back panel is scored along one or more vertical score lines so that it can be folded to a size no wider than the other panels for packaging in the rectangular box.

To assemble a prior art bookcase such as this, the fixed shelves are first attached to the side panels with the included hardware either permanently or semi-permanently depending on the type of hardware used. The hardware holding a typical RTA bookcase together may include a plurality of wooden dowels to attach the fixed shelves and the toe kick panel to the upstanding side panels. Two or more wooden dowels are held in holes in the inner surfaces of the side panels and holes in the ends of the fixed shelves and toe kick panel. The dowels are usually glued in place or are hammered in for a tight friction-fit. By using wood glue, a tight, permanent connection is achieved; however, glue can be messy and lead to sloppy results. Further, wood glue generally takes a long time to dry. While hammered-in dowels often produce neater results, they do not provide the same strength as glue, and much discretion is left to the assembler in how much force to use to hammer in the dowels. Additionally, hammering obviously requires a hammer, which may not be conveniently available in all circumstances.

Instead of, or in addition to dowels, connecting bolts with corresponding cam nuts may be provided to attach the fixed shelves and the toe kick panel to the side panels. These connecting bolts have wood-screw threads on one end and a disc-shaped head on the other end. The threaded end is screwed into a hole in the inner sides of the side panels and the opposite end extends into a hole in the end of a fixed shelf. Each cam nut is fitted into a hole, which communicates perpendicularly with the bolt end hole, in either the top or bottom face of the fixed shelf. The bolt head interlocks with the cam nut within the fixed shelf, whereupon the cam nut is rotated to tighten the connection. This system of bolts and cam nuts generally provides a tight connection between the fixed shelves and the side panels. However, the cam nuts must be precisely aligned in their holes with the bolts or else they will not interlock with the bolts. This often causes great difficulties with assembling the bookcase, especially with the less mechanically inclined. Additionally, a screwdriver is required to assemble the bolts and cam nuts.

After the fixed shelves have been attached to the side panels, the back panel is fitted onto the back of the RTA bookcase. Usually, this is the most tedious and time consuming step of the assembly of the bookcase. Also, this step provides the greatest opportunity for error. The first step in attaching the back panel is placing the partially assembled bookcase front-down on a flat, level surface. Next, pencil marks are made on the back edges of the side panels next to the centers of the fixed shelves. The back panel is then placed, face side down, on the back of the bookcase. At this point it is required that the bookcase side panels and fixed shelves be exactly square. Messy results and an unstable bookcase can easily result from attaching the back panel to an out-of-square frame of panels. In practice, the bookcase is usually not exactly square after attaching the fixed shelves to the side panels, and the panel joints must be flexed somewhat to ensure square alignment of the back panel with the rest of the bookcase frame. After the panels are squared, the back panel is nailed into the top and bottom fixed shelves at the corners of the back panel to prevent the back panel from moving. Next, lines are dram across the back of the back panel between the pencil marks corresponding to the centers of the fixed shelves. Finally, the back panel is nailed into the side panels and fixed shelves using a multitude of nails (usually 25–30) driven around the edges of the back panel and through the lines which extend across the width of the back panel. This requires a great degree of accuracy and again the use of a hammer. If the lines are not drawn over the centers of the fixed shelves or if the nails are hammered in crooked, the nails may protrude through the surface of or miss entirely the fixed shelves or the side panels and be exposed inside the bookcase. This obviously creates unacceptable results.

Finally, the (optional) adjustable shelves are installed. In a typical bookcase, the inner surfaces of the side panels are drilled with two continuous rows of mounting holes that run longitudinally from the top to the bottom of the side panels. The adjustable shelves are held in place between the upstanding side panels by any of several pieces of hardware that are inserted into mounting holes at the desired shelf position. For example, elongated, U-shaped shelving wires may be inserted into and run between two side-by-side holes to support one end of the adjustable shelf. The shelving wires are usually hidden from view within grooves cut into the ends of the adjustable shelf. Alternately, shelf pins having a pegged end and an opposite platform end may be inserted into holes in each side panel to support the adjustable shelves thereon. While mounting the adjustable shelves may seem simple in theory, uneven, tilted shelves often result from misaligning the shelf support hardware. For example, it is usually necessary to count from the nearest fixed shelf, either up or down, the number of holes to the desired location of the fixed shelf. This step must be repeated for each row of holes and piece of support hardware to be used. Often, this results in miscounting and consequent misalignment of the adjustable shelves.

Despite the aforementioned difficulties; correct assembly of the bookcase described above results in a sturdy and attractive, yet relatively inexpensive, piece of furniture. However, the quality of results attained is generally directly proportional to the amount of time spent assembling the structure. Therefore, there exists a need for more easily and quickly assembled RTA furniture that still results in a sturdy, high-quality yet low cost piece.

Previously, several attempts have been made to design furniture that can be packaged with components already attached to one another, yet folded into a collapsed configuration for shipping and storage. For example, U.S. Pat. No. 3,140,133 to Kraft discloses a portable bar having several back panels that are hingedly attached to one another and to side panels with hardware hinges along vertical lines. Shelves are also hingedly attached to the side panels along horizontal lines with hardware hinges. While the Kraft design takes a user's discretion, and therefore likely error, out of assembling the bar, this design requires the use of relatively expensive hardware hinges. These hardware hinges are costly both in terms of material costs and in assembly labor costs. Further, the use of such hardware is not feasible in connection with ready-to-assemble furniture in the price range contemplated by the present invention.

Another previous attempt at designing collapsible, folding, shelved furniture is shown in U.S. Pat. No. 4,082,389 to Stewart. Stewart discloses a multi-shelf cabinet that is made up of a back and two side members joined by block hinges at the upright comers for folding the side members inwardly against the back. The back is split vertically at the center and the two resulting pieces are hinged together. A plurality of shelves are fit into the back and side members and have tenons extending through mortises in the back and side members. However, the Stewart design, like that of Kraft, requires relatively expensive hardware hinges. In addition, the Stewart device is riot designed to be permanent, but is instead collapsible for assembly and use by campers after they have reached a campsite.

Thus, there remains a need for new and improved, ready-to-assemble shelving furniture, such as an RTA bookcase, that can be easily and quickly assembled by almost any person, no matter how mechanically inept, while at the same time providing a sturdy, attractive, high quality piece that does not exceed the price range of existing ready-to-assemble furniture.

SUMMARY OF THE INVENTION

The present invention is directed to a ready-to-assemble (RTA) cabinet, such as a bookcase, which generally includes two upstanding side panels, at least two fixed shelves (upper and lower) between the side panels, a unique folding back panel attached to back edges of said side panels, and an assortment of hardware pieces for holding the components together. Additionally, the bookcase preferably includes a toe kick panel beneath the lowermost shelf and also may optionally include additional fixed and/or adjustable shelves. As is conventional, the shelves and side panels are preferably made of sturdy laminated particle board, whereas the back panel is preferably thinner and is made of laminated high-density cardboard.

The folding back panel preferably includes first and second vertically scored fold lines running from top to bottom along the back surface of the back panel proximate to lateral side edges of the back panel. These first two fold lines delineate two narrow, longitudinal side edge sections of the back panel, which are pre-attached by the manufacturer to the side panels with, for example, staples to create a back panel/side panel sub-assembly. The folding back panel also preferably includes a third vertically scored fold line between the first two scored fold lines. This third fold line bisects the back panel into additional sections and permits the back panel to be folded accordion-style between the side panels when the subassembly is packaged. In the embodiment disclosed, the back panel additionally includes fourth and fifth vertically scored fold lines, thereby subdividing the back panel into six sections. All six sections are preferably narrower than the side panels so that when the back panel/side panel sub-assembly is accordion-folded, the back panel sections do not protrude from between the side panels. With such a construction, the side walls or panels determine the length and width of the package in which the kit is shipped, and yet the difficult assembly operation of a back wall to the side panels is obviated.

To eliminate the problems associated with using conventional hardware to attach the permanent shelves to the side panels, the bookcase of the invention utilizes plastic serrated dowel pins, which include oppositely directed serrations on opposite end portions of the dowel pins. The oppositely directed serrations lock the dowel pins in place within dowel holes in the particle Board panels.

To eliminate problems with miscalculating the height of the adjustable shelves caused by miscounting shelf support holes, the bookcase of the invention divides the shelf support holes into short spaced groups of, for example, three holes each.

Accordingly, one object of the present invention is to provide an RTA cabinet, such as a bookcase, that can be assembled by an average consumer in as little as three to five minutes without using any tools or adhesives.

A further object of the present invention is to provide an RTA cabinet that is partially pre-assembled to enable easy, fast assembly even by persons who are not mechanically inclined.

A further object of the present invention is to provide an RTA cabinet that includes a pre-assembled folded back panel/side panel sub-assembly that eliminates problems commonly encountered with alignment and attachment of the back panel.

A further object of the present invention is to provide that the back panel/side panel sub-assembly can be accordion-folded for packaging in the same size box as a conventional RTA cabinet of the same size.

Another object of the present invention is to provide an RTA cabinet that enables accurate and definite alignment of adjustable shelves.

These and other objects of the present invention will become apparent to those skilled in the art after a reading of the following description of the preferred embodiments when considered with the drawings.

DESCRIPTION OF THE PREFERRED EMBODIMENTS

Figure 1:
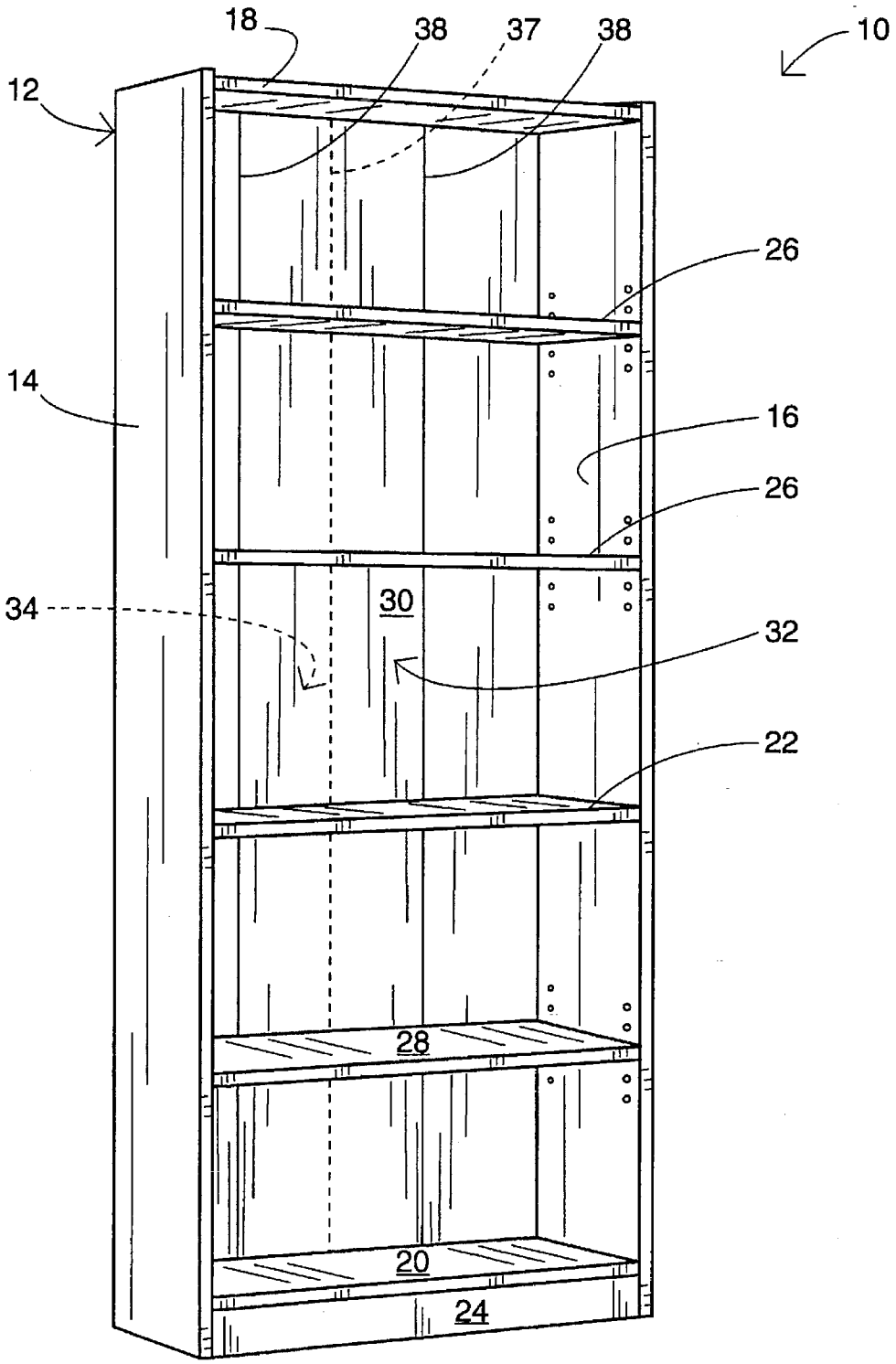
FIG. 1 is a perspective view of an assembled RTA bookcase constructed according to the invention.

Referring now to the drawings in general, it will be understood that the illustrations are for the purpose of describing preferred embodiments of the invention and are not intended to limit the invention thereto. The present invention is directed to a ready-to-assemble (RTA) cabinet, such as the bookcase indicated generally by the numeral 10 in FIG. 1. Of course, other shapes and sizes of shelved cabinets (with or without doors) could just as easily incorporate the structure and method of the present invention and could be adapted to hold any number of objects other than books.

Figure 2:
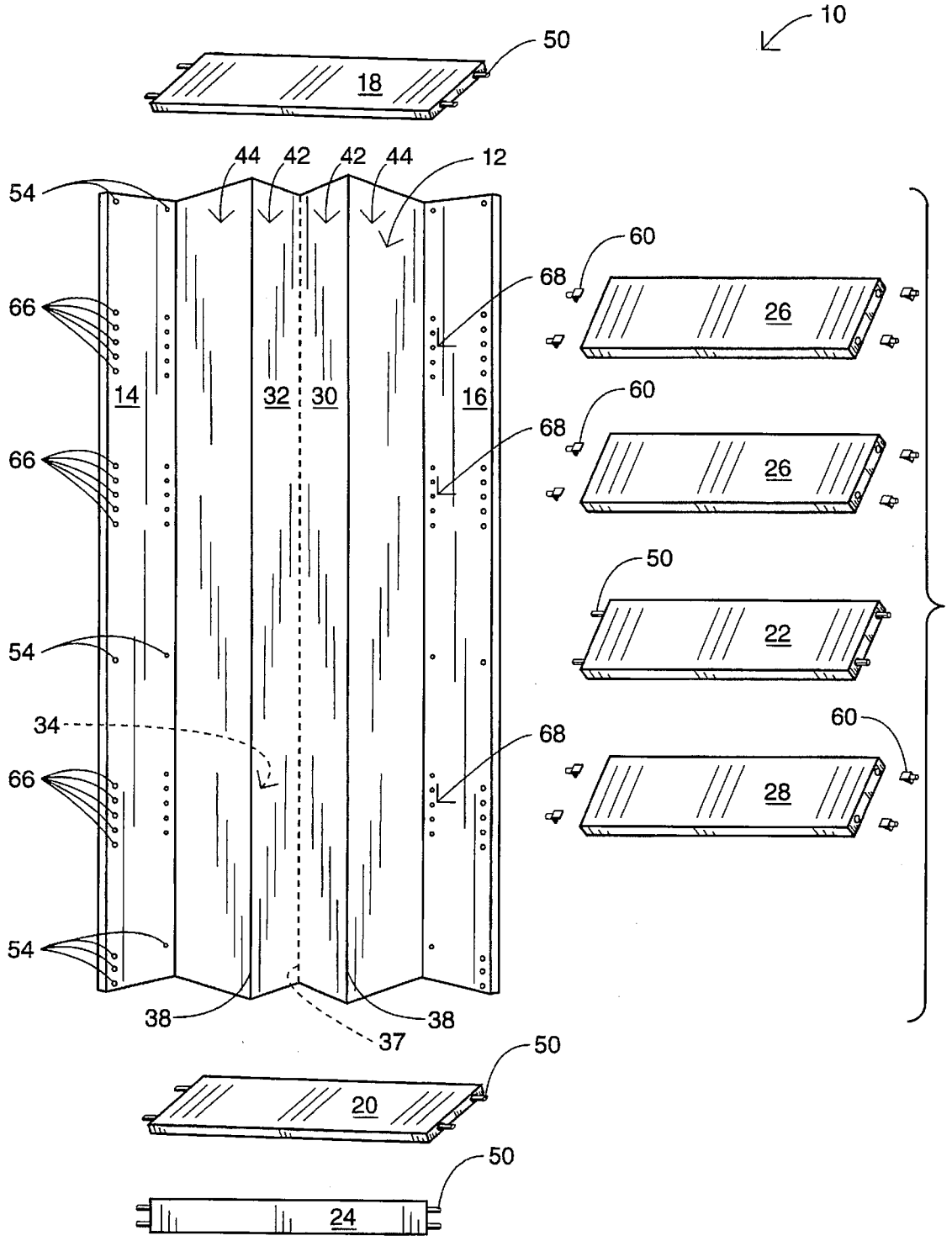
FIG. 2 is an exploded view of the bookcase of FIG. 1.

Turning now to FIG. 2, there is shown an exploded view of a preferred embodiment of the bookcase 10 generally including upstanding side panels 14, 16, a folding back panel 30 attached to back edges of the side panels, a plurality of fixed shelves 18, 20, and 22, and adjustable shelves 26, 28 between the side panels, a kick plate 24, and an assortment of hardware pieces 50, 60 for holding the other components together. As will be explained below, the side panels and the back panel are packaged and sold pre-assembled as a sub-assembly 12.

The upstanding side panels include left side panel 14 and right side panel 16. The side panels are preferably mirror images of each other and are preferably rectangular in shape. While the side panels 14, 16 could be made of almost any sturdy material such as wood, they are preferably made of particle board or hollow core panels that is covered with veneer for an attractive appearance and for protection. A multitude of holes 54 and 66 are bored into inside surfaces of the side panels. As should be understood, these holes 54, 66 are for attaching the shelves, as will be described below.

Figure 3:
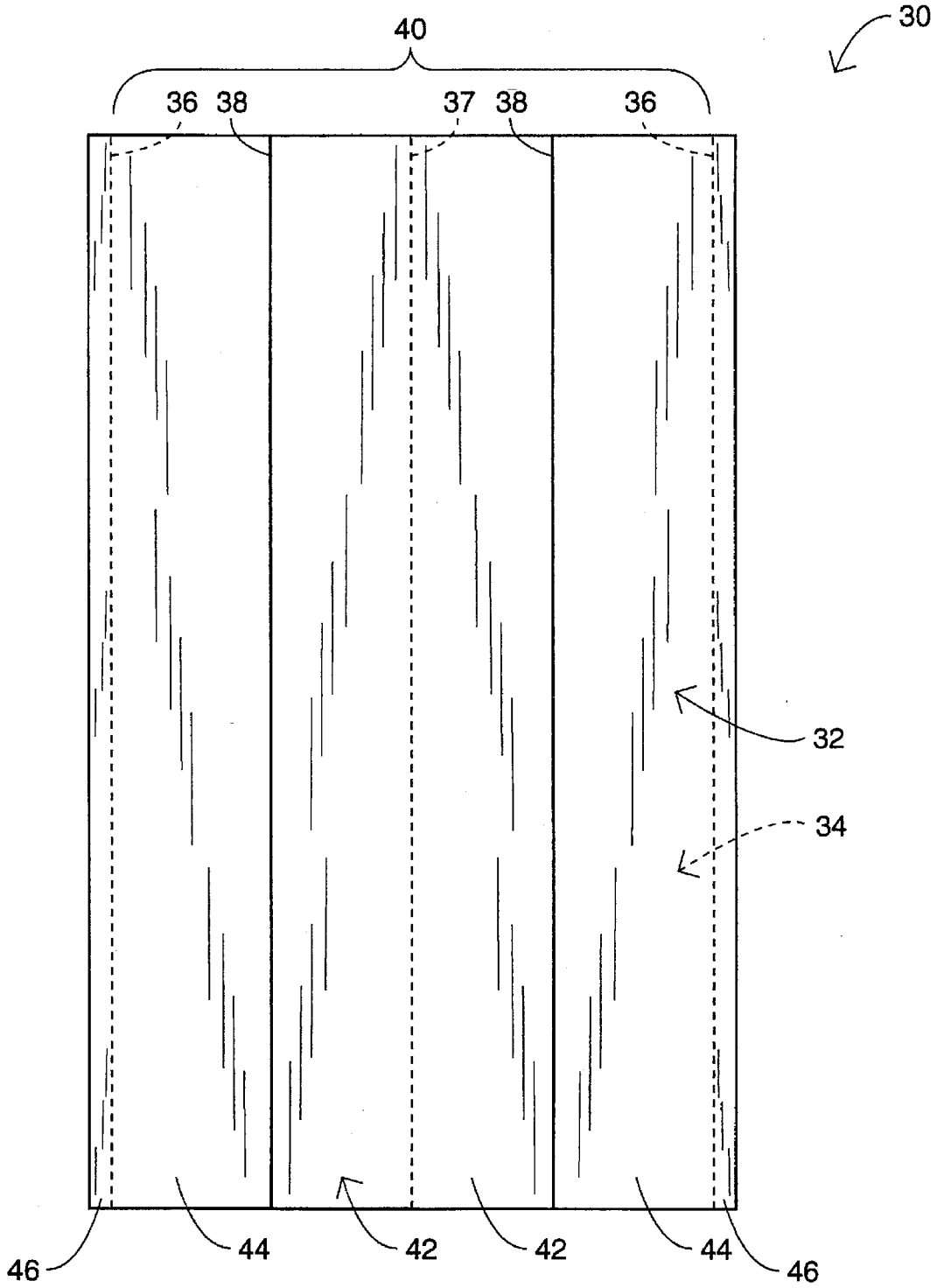
FIG. 3 is a plan view of the back panel removed from the side panels and illustrating a plurality of vertically scored fold lines that subdivide the back panel/side into a plurality of longitudinal sections.

To enable quick, easy, and accurate assembly of the bookcase 10 of the invention, the side panels 14, 16 are pre-attached to the folding back panel 30 before the RTA bookcase 10 reaches a consumer. Together, the side panels 14, 16 and the folding back panel 30 form sub-assembly 12, which takes almost all ambiguity out of assembling the bookcase 10. Turning first to the back panel 30 itself, FIG. 3 shows a preferred embodiment of the back panel before it is attached to the side panels 14, 16. The back panel 30 may be made of any somewhat creasible, flat material, but is preferably made of high-density cardboard or fiber-board. A front face 32 is covered with veneer both for protection and so that the back panel will match the side panels and shelves. To permit the back panel/side panel sub-assembly 12 to be folded accordion-style, the back panel 30 is scored with a plurality of vertical fold lines that run top to bottom along the surfaces of the back panel, thereby subdividing the back panel 30 into distinct longitudinal sections.

As seen in FIG. 3, the scored fold lines include two side edge fold lines 36 scored on a rear surface 34 of the back panel 30 proximate opposite side edges of the back panel 30. Each side edge fold line 36 delineates a vertically oriented side edge section 46 outside each fold line 36, and a central section 40 between fold lines 36. In the preferred embodiment, a central scored fold line 37 is cut into the rear surface 34 of the back panel 30 and runs Vertically top to bottom between the two side edge score lines 36, thereby bisecting the back panel 30. Preferably, two additional fold lines 38 are also scored in the front face 32 of the back panel 30. In all, the preferred embodiment of the invention includes five vertically scored fold lines, which subdivide the back panel into six longitudinal, vertically oriented sections: the aforementioned side edge sections 46, inner accordion sections 42, and outer accordion sections 44. As will be appreciated, each back panel section preferably has a width that is narrower than that of the side panels 14, 16. Further side edge sections 46 have a width dimension which is equal to or slightly less than the corresponding edge dimension of side panels 14,16.

Figure 4:
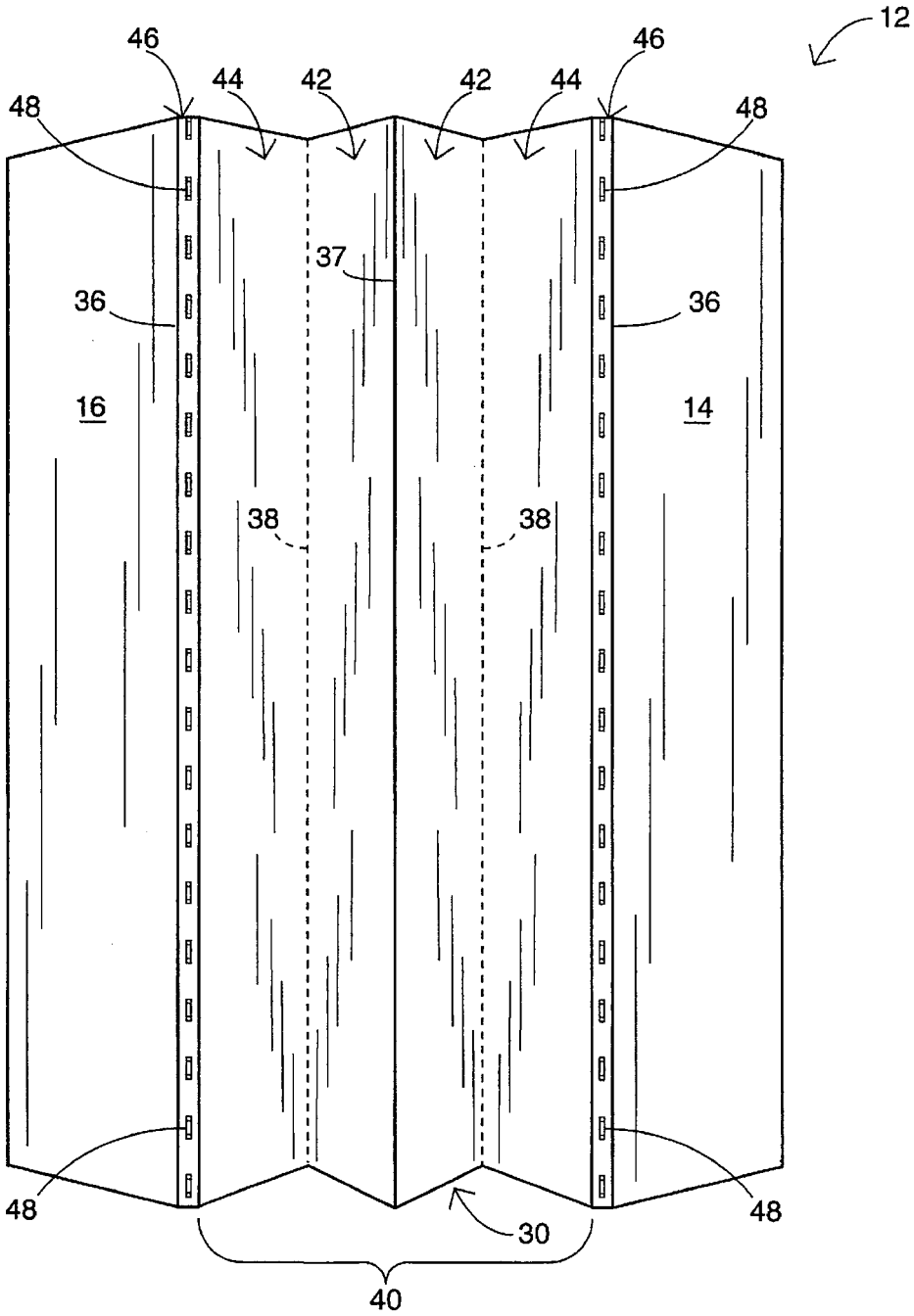
FIG. 4 is a rear perspective view of the pre-assembled back panel/side panel sub-assembly, which is shown here partially folded accordion-style.
Figure 4A:
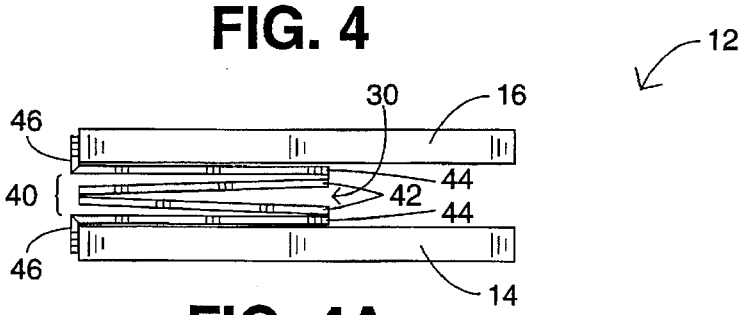
FIG. 4A is a top end view of the back panel/side panel sub-assembly, shown here completely folded.

Turning now to the back panel/side panel sub-assembly 12, best shown in FIGS. 4 and 4A, it can be seen that the side panels 14, 16 are each attached to one of the side edge sections 46 of the back panel 30. In the preferred embodiment, a series of fasteners 48 are driven through the side edge sections 46 and into the back edges oft he side panels 14, 16. Fasteners 48 may be staples, screws, nails, tacks, pins, etc. Alternately, the side panels 14, 16 could be attached to the back panel 30 with glue. This pre-assembly step is preferably performed using automated machinery before the components of the bookcase 10 are packaged and sold. Therefore, exact alignment of the back panel 30 with the side panels 14, 16 can be consistently achieved and assembly time by the consumer can be drastically reduced. Additionally, great manufacturing labor and material cost savings are realized by attaching the back panel 30 to the side panels 14, 16 with fasteners 48 and by providing for folding of the sub-assembly 12 with scored fold lines instead of much more expensive hardware hinges.

As seen in FIG. 4A, the sub-assembly 12 can be folded accordion-style along the scored fold lines so that a very compact and easily packaged configuration results. The central section 40 of the back panel 30, which includes the inner accordion sections 42 and the outer accordion sections 44, is folded between the two side panels 14, 16. The side edge sections 46 are attached to the back edges of the side panels 14, 16. An examination of FIG. 4A reveals the reason why each back panel section 42, 44, and 46 has a width less than that of the side panels 14, 16. This is so the back panel 30 can be folded completely within the folded sub-assembly 12 for the smallest possible configuration. The only parts of the back panel 30 that remain exposed wherein the sub-assembly 12 is completely folded are the side edge sections 46, which are attached to the back edges of the side panels 14, 16. Therefore, the length and width of the side panels determine the length and width of the shipping carton. So packaged, the carton can be carried in the mink of a car.

Depending on the width of the bookcase 10 desired, other conceivable embodiments of the sub-assembly (not shown) could be created, wherein a different number of fold lines would be scored in the back panel. For example, if a substantially unscored back was desired, the back could be scored only with the two side edge fold lines 36. Then, the side panels could be attached to the side edge sections 46 and folded inwardly towards each other for packaging with the side panels side-by-side. The back panel would not fold into an accordion-shape in this instance, but would remain flat and unfolded save for the two side edge sections 46. In this instance, it should be appreciated that a wider, flatter package would result.

In another conceivable embodiment of the invention (not shown), the additional fold lines 38 could be omitted so that the back panel would be subdivided into only four sections. If so, then the central scored fold line 37 would be cut into the front face 32 of the back panel 30 instead of the back surface 34. With this configuration, the sub-assembly could still be folded accordion-style with the back panel being sandwiched in between the side panels 14, 16. Other conceivable variations include increasing the width of the back panel and accordingly increasing the number of scored fold lines to seven, for example, if a particularly wide bookcase 10 was desired.

Turning now to the shelves and hardware, FIGS. 1 and 2 best show the preferred configuration of the shelves. While it is conceivable that only one permanent shelf could be utilized, the preferred embodiment includes at least a top fixed shelf 18 and a bottom fixed shelf 20. These shelves 18, 20 are disposed between the side panels 14, 16 and are permanently attached to the inner surfaces thereof, as will be described below. In the embodiment disclosed, a middle fixed shelf 22 is also provided between the top and bottom fixed shelves 18, 20, although the middle fixed shelf 22 is optional. Also optional are one or more adjustable shelves, including upper adjustable shelf 26 and lower adjustable shelf 28. As is conventional with RTA bookcases, a forwardly facing toe kick panel 24 is provided beneath the bottom fixed shelf 20. All of the shelves and the kick panel are preferably composed of the same veneer-covered particle board as the side panels 14, 16.

Figure 5:
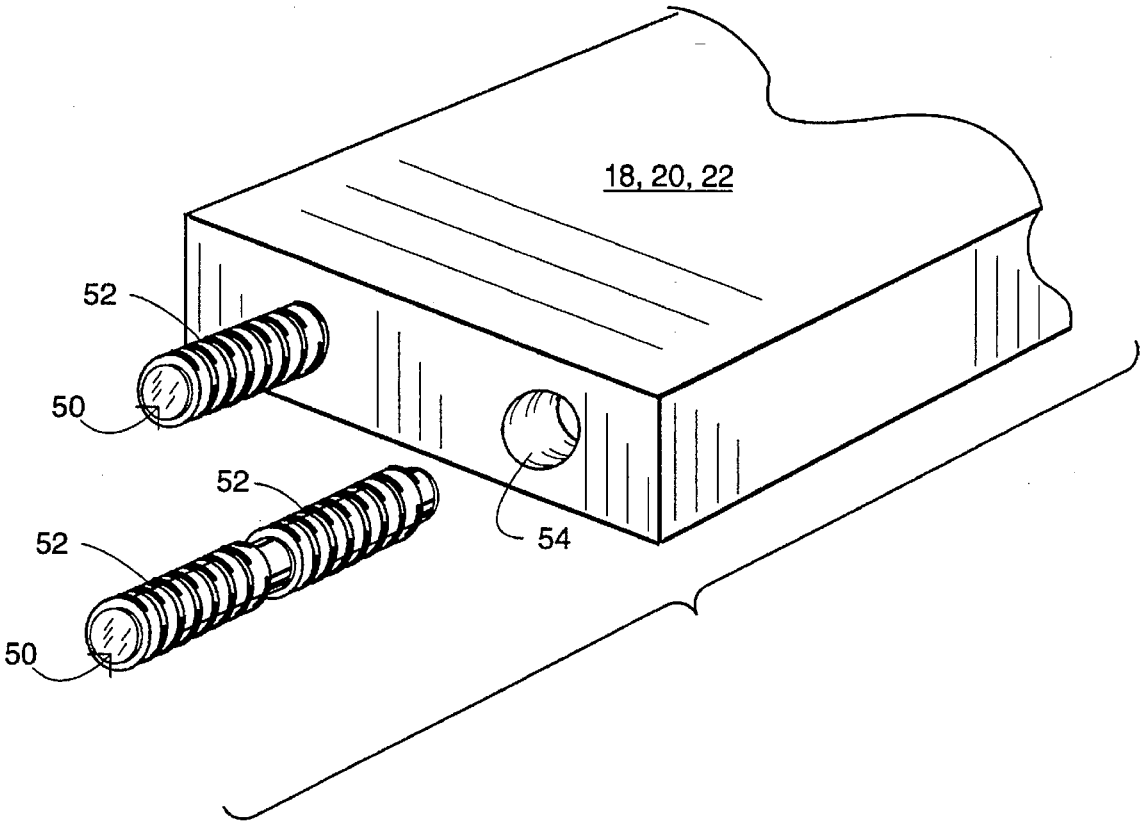
FIG. 5 is a close-up perspective view of one end of one of the fixed shelves, showing the serrated dowels that attach the fixed shelves to the side panels.

As shown best in FIG. 5, the fixed shelves 18, 20, 22 (and the toe kick panel 24) are all fixedly attached to the side panels 14, 16 by dowel pins 50. As is conventional, the dowel pins 50 are seated in holes 54 bored both into the inner surfaces of the side panels 14, 16 and into the side edges of the fixed shelves 18, 20, 22. However, unlike with conventional RTA bookcases, the fixed shelves of the present invention are held in place with plastic dowel pins 50 that have oppositely directed serrations 52 on opposite end portions of the dowel pins 50. An example of such a plastic dowel pin is disclosed in U.S. Pat. No. 3,883,258 to Hewson, which is hereby expressly incorporated by reference. These serrations 52 act as barbs to lock the dowel pins 50 in place within the holes 54 without the need for glue or other messy adhesives. Additionally, because the dowel pins 50 are preferably made of slightly flexible plastic, they can be inserted into the holes 54 without a hammer. Preferably, the dowel pins 50 are inserted into the fixed shelf and toe kick panel holes by the manufacturer of the RTA bookcase 10. Then, during assembly, the consumer must only insert the dowel pins 50 into the holes 54 in the inner surfaces of the side panels 14, 16.

Figure 6:
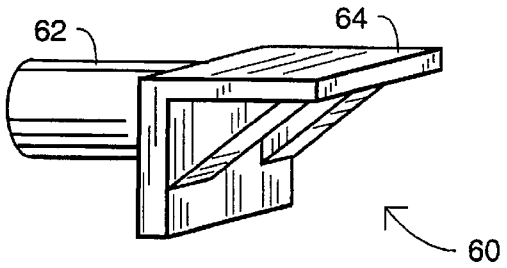
FIG. 6 is a perspective view illustrating a shelf support pin for mounting the adjustable shelves in the bookcase.

The adjustable shelves 26, 28, on the other hand, are supported between the side panels 14, 16 by conventional shelf pins 60, such as the one illustrated in FIG. 6. Such shelf pins 60 include a platform end 64 for supporting one end of an adjustable shelf and a peg end 62 for insertion into a peg hole 66 in the inner surface of a side panel. Alternately, wire supports or other conventional shelf support hardware could be used. Unlike conventional RTA bookcases, which typically include vertical rows of peg holes extending continuously from the top to the bottom of the side panels, the side panels 14, 16 of the invention have peg holes 66 grouped in short vertical rows 68. In the embodiment disclosed, each short vertical row 68 includes three peg holes 66 although four or five holes are also contemplated. The advantage of providing only short rows of holes instead of one long, continuous row is that miscounting and resulting shelf misalignment is prevented. It is far easier to count one of only three or four holes, in which to position shelf support hardware, than it is to count ten to fifteen holes above or below a fixed shelf to determine the correct position for the shelf support hardware. While shelf misalignment due to positioning shelf hardware inconsistently is not an uncorrectable problem, it nevertheless wastes time. Sometimes, such an assembly flaw is noticed only after a bookcase has been filled with books or other objects, which must then be taken down so that the misaligned shelf can be repositioned.

Now turning to the actual assembly of the bookcase 10, while prior art RTA bookcases typically require about forty minutes for assembly, the RTA bookcase 10 of the present invention can be assembled by even an unskilled consumer in as little as three to five minutes. Before packaging, the bookcase 10 is preferably partially assembled by the manufacturer. The back panel/side panel sub-assembly 12 is preassembled by the manufacturer, as described above, and is packaged accordion-folded. Additionally, the serrated dowel pins 50 are preferably pre-inserted into dowel holes 54 bored into the ends of each fixed shelf 18, 20, 22 and the toe kick panel 24 before packaging.

The steps a consumer must perform to assemble the bookcase 10 are therefore few in number and easy to accomplish. First, the accordioned sub-assembly 12 is unfolded on a flat, level surface with the back surface 34 of the back panel 30 facing down. At this point, the longitudinal sections of the back panel 30 are all generally disposed in a single plane. Next, the fixed shelves 18, 20, 22 and the toe kick panel 24 are attached to the left side panel 14 by inserting the serrated dowel pins 50, which extend from the side edges of the fixed shelves and toe kick panel, into the corresponding dowel holes 54 in the inner surface of the side panel 14. No glue is needed, as the serrations 52 lock the dowels 50 in place within the holes 54. Next, the right side panel is rotated into position adjacent the opposite ends of the shelves and toe kick panel. The fixed shelves 18, 20, 22 and the toe kick panel 24 are attached to the right side panel 16 in the same manner as the left. At this point, the left and right side panels 14, 16 stand perpendicularly above the back panel 30, and the fixed shelves 18, 20, 22 rest atop the back panel on their back edges, perpendicular to the side panels 14, 16 and the back panel 30. The bookcase 10 may then be raised into its standing position. To install the optional adjustable shelves 26, 28, the desired position of the adjustable shelves 26, 28 is determined, and the shelf pins 60 are inserted into appropriate peg holes 66. The adjustable shelves 26, 28 are then rested on the shelf pins 60 to complete the assembly of the bookcase 10.

As should be appreciated, no tools or adhesives and minimal assembly time are needed to assemble the bookcase 10 of the invention. The serrated dowels 50 are easily inserted into the appropriate dowel holes 54 with no more force necessary than can be applied by a person's bare hands. The same is true for the insertion of the shelf pins 60 into the peg holes 66. Because the back panel 30 has been preattached to the side panels 14, 16 by the manufacturer, the tedious steps of aligning and nailing the back panel are eliminated. Further, because the bookcase of the invention utilizes self-locking serrated dowels 50 to attach the permanent shelves, messy, slow-drying glue and complicated cam nut/connecting bolt devices are eliminated.

Certain modifications and improvements will occur to those skilled in the art upon a reading of the foregoing description. For example, the bookcase 10 of the invention could be modified by attaching doors to the front. Also drawers or pull out shelves could be added. It should be understood, however, that all such modifications and improvements have been deleted herein for the sake of conciseness and readability, but are properly within the scope of the following claims.

What is claimed is:

1. A ready-to-assemble cabinet, comprising:

a) two upstanding side panels and a folding back panel formed separately from said side panels, said folding back panel made of a different and thinner material than said side panels;

b) at least two fixed shelves disposed between said side panels ad fixedly attached to said side panels; and c) said folding back panel having lateral edges, wherein:

i) said folding back panel includes at least two side edge fold lines scored proximate said lateral edges of said back panel and framing vertically from a top to a bottom of said back panel, ii) said lateral edges of said folding back panel are pre-attached to said side panels by one or more of the group consisting of fasteners and adhesives to create a back panel/side panel sub-assembly prior to assembly of the cabinet, and iii) said back panel/side panel sub-assembly can be folded along the scored fold lines into a compact configuration for packaging.

2. The ready-to-assemble cabinet of claim 1, further comprising a toe kick panel attached between said side panels and below a lower of said fixed shelves.

3. The ready-to-assemble cabinet of claim 1, further comprising a third fixed shelf attached between said side panels.

4. The ready-to-assemble cabinet of claim 1, further comprising at least one adjustable shelf disposed between said side panels.

5. The ready-to-assemble cabinet of claim 4, wherein said adjustable shelf is supported between said side panels on shelf support hardware mounted in shelf support holes in said side panels.

6. The ready-to-assemble cabinet of claim 5, wherein the shelf support holes are grouped in short, vertical rows on inner surfaces of said side panels.

7. The ready-to-assemble cabinet of claim 6, wherein there are at least three of said shelf support holes in each short, vertical row of holes.

8. The ready-to-assemble cabinet of claim 1, wherein said fixed shelves are fixedly attached to said side panels by dowel pins disposed in dowel holes in inner surfaces of said side panels and in dowel holes in side edges of said fixed shelves.

9. The ready-to-assemble cabinet of claim 8, wherein said dowel pins are made of plastic and include opposite directed serrations on opposite end portions of said dowel pins, said oppositely directed serrations for locking said dowel pins in place within the dowel holes.

10. The ready-to-assemble cabinet of claim 9, wherein said back panel is stapled to said side panels prior to folding said back panel/side panel sub-assembly into a compact configuration for packaging.

11. A folding back panel and side panel sub-assembly for a ready-to-assemble cabinet having fixed shelves, said sub-assembly comprising:

a) two upstanding side panels and a folding back panel formed separately from said side panels, said folding back panel made of a different and thinner material than said side panels;

b) said folding back panel including:

i) at least three fold lines running vertically from top to bottom along at least one surface of said folding back panel, ii) said fold lines subdivide said back panel into at least four longitudinal sections, including two accordion sections and two edge sections, and iii) said edge sections of said folding back panel are pre-attached to back edges of said side panels by one or more of the group consisting of fasteners and adhesives to form a sub-assembly which can be folded accordion-style along the fold lines into a compact configuration for packaging.

12. The folding back panel and side panel sub-assembly of claim 11, wherein said fasteners comprise a plurality of staples extending through each edge section and into the back edge of each side panel.

13. The folding back panel and side panel sub-assembly of claim 11, wherein all of said longitudinal sections are narrower in width than said side panels.

14. The folding back panel and side panel sub-assembly of claim 11, wherein two of said fold lines are side edge fold lines that are scored proximate opposite lateral side edges of said back panel.

15. The folding back panel and side panel subassembly of claim 14, wherein said two side edge fold lines are both scored on a back surface of said back panel, and wherein said back panel further includes a central scored fold line between said two side edge fold lines and bisecting said back panel.

16. The folding back panel and side panel sub-assembly of claim 15, wherein said central scored fold line is scored on the back surface of said back panel, and wherein said back panel further includes additional fourth and fifth scored fold lines cut into a front surface of said back panel, thereby subdividing said back panel into six longitudinal sections.

17. The folding back panel and side panel sub-assembly of claim 11, wherein said back panel is formed of high-density cardboard material.

18. The folding back panel and side panel sub-assembly of claim 17, wherein said side panels are formed of particle board material.

19. A ready-to-assemble cabinet, comprising:

a) two upstanding, vertically disposed side panels;

b) at least two fixed shelves horizontally disposed between said side panels and fixedly attached to said side panels; and c) a folding back panel formed separately from said side panels and attached to back edges of said side panels, said folding back panel made of a different and thinner material than said side panels; said folding back panel including:

i) a first vertically scored fold line running along a back sure, tee of said back panel proximate a lateral side edge of said back panel, said first fold line delineating a first longitudinal side edge section of said back panel, ii) a second vertically scored fold line running along the back surface of said back panel proximate an opposite lateral side edge of said back panel, said second fold line delineating a second longitudinal side edge section of said back panel, iii) at least one additional vertically scored fold line running along the front surface of said back panel between said first and second scored fold lines, said additional fold line further subdividing said back panel into additional longitudinal sections, and iv) one or more of the group consisting of fasteners and adhesives for pro-attaching the side edge sections of said back panel to the back edges of said side panels, v) whereby the folding back panel and side panels can be folded together as one unit along the scored fold lines into an accordion configuration.

* * * * *

UNITED STATES PATENT AND TRADEMARK OFFICE

CERTIFICATE OF CORRECTION

PATENT NO. : 5662399

DATED : 9/2/97

INVENTOR(S) : Richard E. Henkel; William A.Matzke; James T. Phillips

It is certified that error appears in the above-indentified patent and that said Letters Patent is hereby corrected as shown below:

In the Claims

In Claim 1, column 9, line 21, delete "framing" and insert in lieu thereof --running--.

In Claim 19, column 10, line 56, delete "sure,tee" and insert in lieu thereof --surface--.

In Claim 19, column 11, line 4, delete "pro-attaching" and insert in lieu thereof --pre-attaching--.

Signed and Sealed this

Twenty-fifth Day of May, 1999

*Attest:*

Q. TODD DICKINSON

*Attesting Officer*

*Acting Commissioner of Patents and Trademarks*